US005978980A

United States Patent [19]

Flora

[11] Patent Number: 5,978,980

[45] Date of Patent: Nov. 9, 1999

[54] NECK CUSHIONING DEVICE

[76] Inventor: Marsha A. Flora, 15838 Maple, Overland Park, Kans. 66223

[21] Appl. No.: 09/179,182

[22] Filed: Oct. 27, 1998

[51] Int. Cl.[6] ..... A45D 44/10

[52] U.S. Cl. ..... 4/523

[58] Field of Search ..... 4/515, 516, 517, 4/518, 519, 523

[56] References Cited

U.S. PATENT DOCUMENTS

| | | | |
|---|---|---|---|
| 2,948,903 | 8/1960 | Gilmer | 4/523 |
| 4,411,032 | 10/1983 | Lewy . | |
| 4,671,267 | 6/1987 | Stout . | |
| 4,763,364 | 8/1988 | Morgan . | |
| 4,887,326 | 12/1989 | O'Brien | 5/421 |
| 4,949,407 | 8/1990 | Singer et al. . | |
| 5,377,365 | 1/1995 | Hakim . | |

*Primary Examiner*—Charles E. Phillips
*Attorney, Agent, or Firm*—Sonnenschein Nath & Rosenthal

[57] ABSTRACT

A neck cushioning device is adapted for use with a shampoo basin having a neck-receiving notch and includes a cushioning pad formed of a gel-based material. The shape of the cushioning pad is configured in such a way that the neck cushioning device conforms to a variety of different-shaped neck-receiving notches in shampoo basins. The shape of the cushioning pad is symmetrical about two orthogonal axes, with the first of these axes being generally transverse to a person's head and neck. The first dimension of the cushioning pad along the first axis is greater than a second dimension of the cushioning pad along the other of the two axes. The neck cushioning device includes a covering for housing the cushioning pad which is formed of a flexible, water-repellent material. The covering includes a pair of flap portions on opposed sides of the first axis of the cushioning pad. The flap portions include components for releasably securing the neck cushioning device to the shampoo basin.

16 Claims, 2 Drawing Sheets

NECK CUSHIONING DEVICE

FIELD OF THE INVENTION

The present invention relates to neck cushions, and more particularly, to a neck cushioning device for supporting the neck of a patron from the hard surface of a shampoo basin.

BACKGROUND OF THE INVENTION

Professional hair stylists and barbers typically utilize a shampoo basin or bowl for shampooing the hair of their patrons. The patron reclines in a chair such that the head of the patron is within the basin with the neck resting against the rim of the basin. Most shampoo basins include a neck-receiving notch, which is either a U-shaped or V-shaped configuration, to receive the patron's neck during shampooing or other hair treatment.

Typically, the basins are made of a hard porcelain, fiberglass, or another similar material which can cause considerable discomfort to a patron's neck when the patron is reclined during the shampooing operation. To alleviate this discomfort, several neck cushioning devices for use with shampoo basins have been proposed in the art.

For example, U.S. Pat. No. 4,763,364 to Morgan discloses a neck cushioning device comprised of a cushion of resilient material coated with a flexible, water-repellent substance over the entire surface. The cushioning device is adapted to overlay a U-shaped neck-receiving notch typically found on commercial shampoo bowls. The cushioning device wraps laterally around the edges of the notch for engagement therewith by means of downwardly projecting walls, one of which includes a protruding lip that curls around the notch and secures the cushioning device to the bowl.

Another shampoo basin neck rest is described in U.S. Pat. No. 4,949,407 to Singer et al. In this patent, the neck rest comprises a generally semi-cylindrical cushion made of a soft resilient material, such as neoprene, rubber, or plastic foam, with a thin coating of a waterproof and chemically resistant material. A flexible material is attached to the inner semi-cylindrical surface of the cushion and includes a plurality of small suction cups to secure the cushion to the basin.

Although the above-described neck cushioning devices alleviate some of the discomfort associated with shampooing or other hair treatment, several problems still exist with these and other prior support devices. For example, most of the previously proposed neck support designs do not readily conform to a variety of shampoo bowls, such as what are commonly referred to as U-shaped shampoo bowls or V-shaped shampoo bowls. Also, the thickness of many prior neck protection devices creates too much bulk in the neck area. Consequently, the necks of patrons do not properly fit within the neck support which can allow water to run down the back of a patron during shampooing.

While existing neck support devices have tried to include components for securing the support device to the basin, the shapes of many of these neck supports lend themselves to slippage during the shampoo process. Also, traditional neck supports fail to prevent water from being trapped in the support allowing bacteria to grow, thus making the support unsanitary. Finally, many neck supports only protect the base of the neck without giving total support to the neck.

SUMMARY OF THE INVENTION

In view of the foregoing, it is a primary object of the present invention to provide a neck cushioning device that conforms to all types of shampoo basins, including U-shaped sinks as well as V-shaped sinks.

Another object of this invention is to provide a neck cushioning device formed of a gel-based material which is thin yet comfortable and thus does not create unnecessary bulk.

In this regard, it is a related object of the present invention to provide a neck cushioning device that forms and fits with any patron's neck, thereby providing the patron with comfort and allowing the patron to extend her neck and head properly back into a shampoo basin.

Yet another object of this invention is to provide a neck cushioning device that remains securely attached to the shampoo basin during shampooing.

Still another object of this invention is to provide a completely sanitary neck cushioning device that prevents water or other chemicals from deteriorating the cushion.

These and other aims and objectives are accomplished with the neck cushioning device of the present invention. The neck cushioning device is adapted for use with a shampoo basin having a neck-receiving notch. The neck cushioning device includes a cushioning pad formed of a gel-based material. The shape of the cushioning pad is configured in such a way that the neck cushioning device conforms to a variety of different-shaped neck receiving notches in shampoo basins. The shape of the cushioning pad is symmetrical about two orthogonal axes, with a first of these axes being generally transverse to a person's head and neck. A first dimension of the cushioning pad along the first axis is greater than a second dimension of the cushioning pad along the other of the two axes. The neck cushioning device also includes a covering for housing the cushioning pad and formed of a flexible water-repellent material. The covering includes a pair of flap portions on opposed sides of the first axis of the cushioning pad. The flap portions include components for releasably securing the neck cushioning device to the shampoo basin.

These and other objects and advantages of the present invention will be apparent from the following description of the preferred embodiments in connection with the drawings, the disclosure and the appended claims.

BRIEF DESCRIPTION OF THE DRAWINGS

The various aspects of the invention are described in detail below, with reference to the drawings, in which.

DETAILED DESCRIPTION OF THE PREFERRED EMBODIMENTS

Figure 1A:
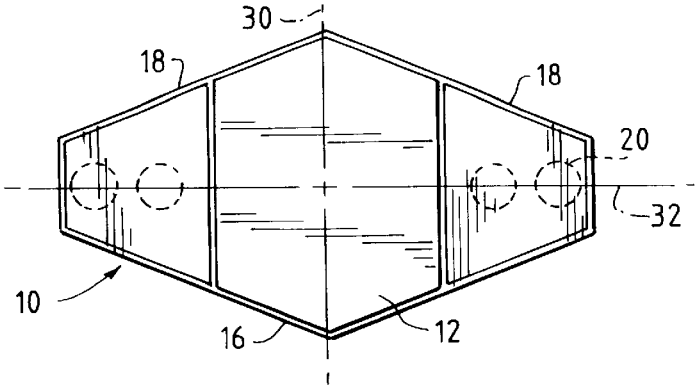
FIGS. 1A–1D are perspective views of the neck cushioning device of the present invention.
Figure 1B:
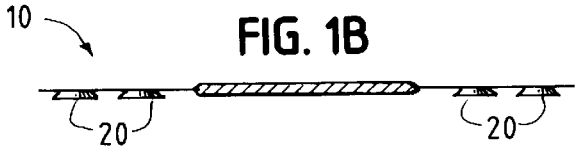
Figure 1C:
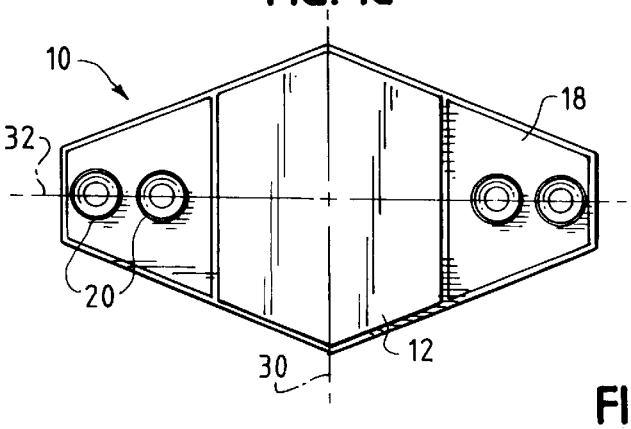
Figure 1D:
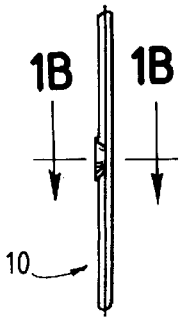

Turning now to the drawings, a neck cushioning device according to the present invention is broadly designated in the drawings by the reference numeral 10. Neck cushioning device 10 is to be used by hairstylists and barbers to support the neck of patrons during shampooing or other hair treatment. As shown in FIG. 1A and 1C, the neck cushioning device 10 includes a cushioning pad 12 which is formed of a gel-based material. The cushioning pad is generally hexagonal in shape and is adapted to conform to a variety of different-shaped shampoo basins.

Figure 2:
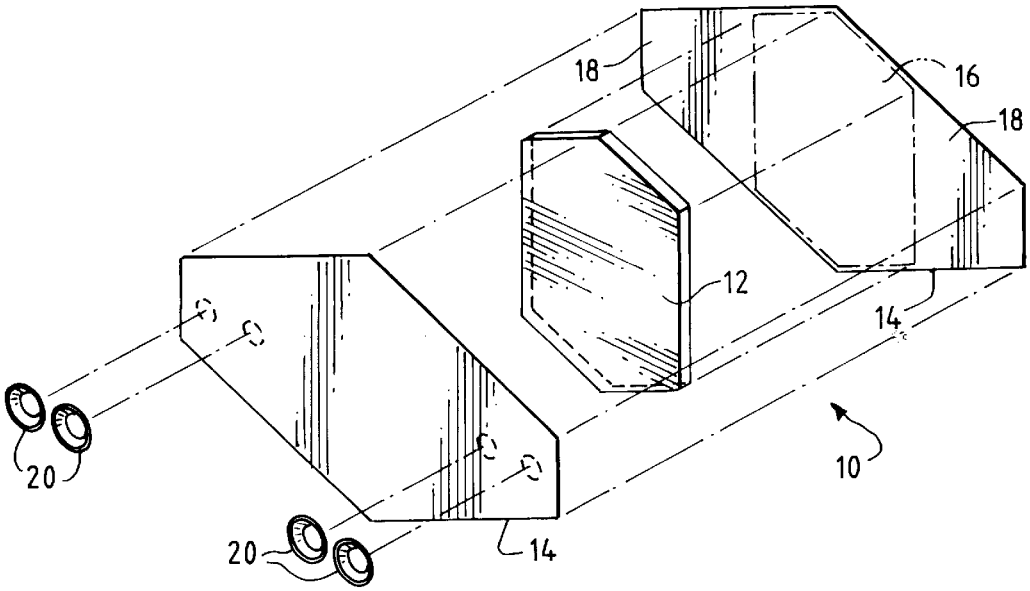
FIG. 2 is a perspective view illustrating the components of the neck cushioning device of the present invention.

As can be seen in FIG. 2, the gel-filled cushioning pad 12 is encased within a covering 14 which securely houses the cushioning pad. The covering 14 is formed of a flexible, water-repellent material such as vinyl, polyethylene, or a like material. As can be seen in the drawings, gel-filled cushioning pad 12 securely fits within a region 16 of covering 14. Covering 14 also includes a pair of flaps 18 on either side of the cushioning pad 12 to wrap around the rim of shampoo basins. In order to releasably secure neck cushioning device 10 to the shampoo basin, in the illustrated embodiment, suction cups 20 are provided on the flap portions so that the cushioning device maintains a secure fit with the shampoo basin. As shown in FIG. 2 it is preferred to use suction cups 20 although any other securing means like Velcro may be employed.

An important aspect of the present invention is the use of a gel-based material for the cushioning pad 12. The use of a gel allows the neck cushioning device to remain thin so that undue bulk is unnecessary to provide comfort. Additionally, gel-based material is much better adapted to conforming to any person's neck as opposed to foam rubber or other cushioning devices proposed in existing neck supports.

Figure 3A:
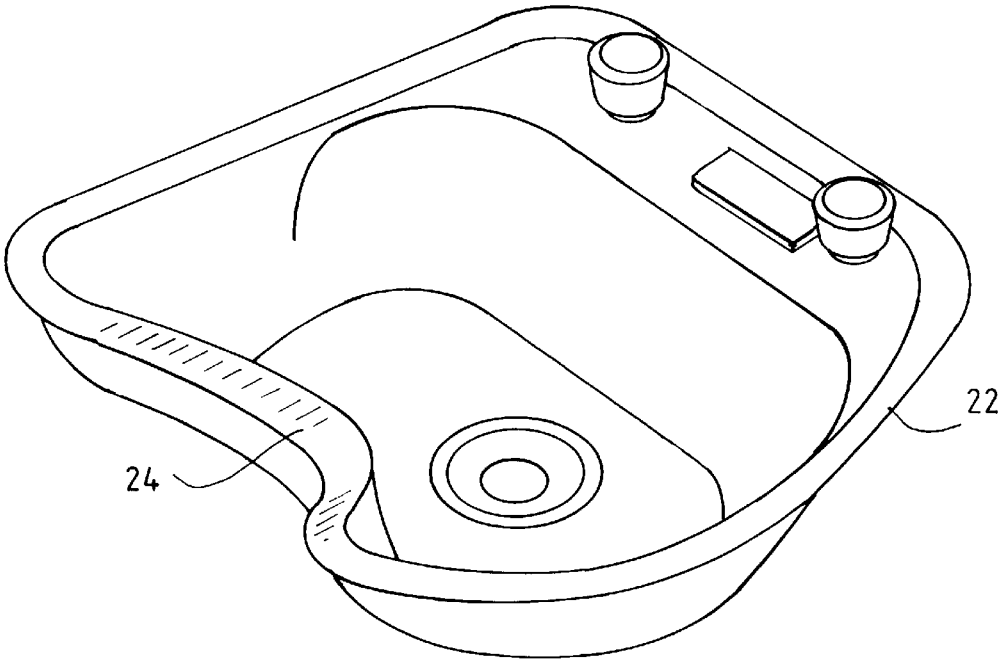
FIGS. 3A-3B are perspective views of two different types of shampoo basins for which the neck cushioning device of the present invention finds application.
Figure 3B:
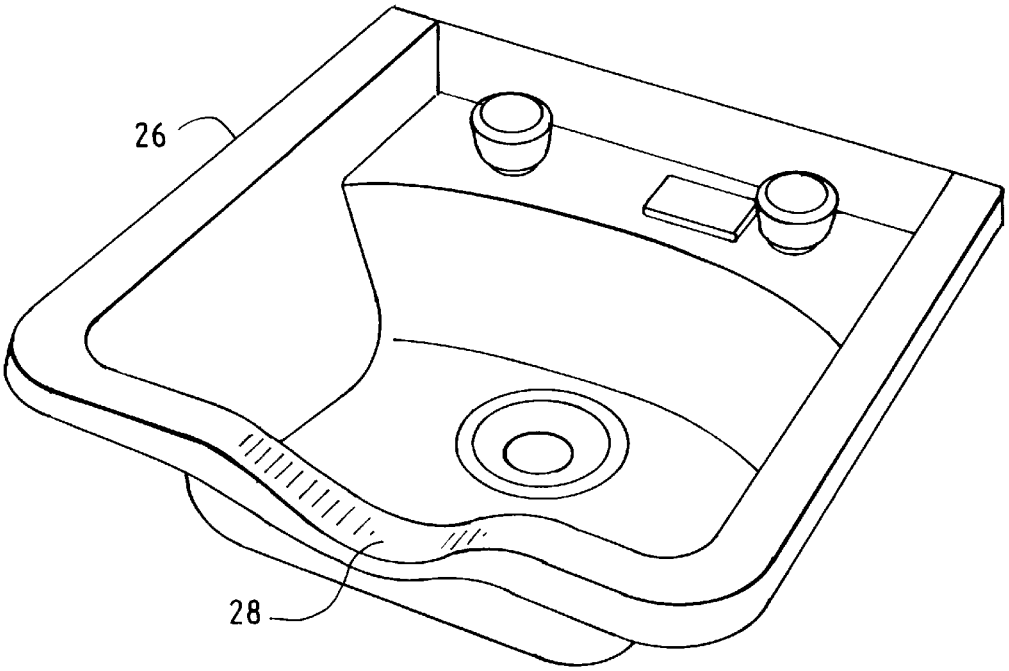

Another important advantage of the use of a gel in connection with the cushioning pad 12 is that it is easily conformed to a variety of different shampoo basins. For example, FIG. 3A shows what is commonly referred to as a V-shaped shampoo basin 22. The V-shaped shampoo basin includes a neck-receiving notch 24 generally in the form of a V for receiving a patron's neck. Alternatively, another common shampoo basin used in the hairstyling industry is a U-shaped shampoo basin 26 as shown in FIG. 3B. Shampoo basin 26 also includes a neck-receiving notch 28 in a generally U-shaped configuration. Unlike existing neck supports, the neck cushioning device 10 of the present invention can readily conform to both the U-shaped and V-shaped shampoo basins as well as other shampoo basin designs.

In addition to the use of a gel-based material, the general configuration of the cushioning pad 12 is important to providing a neck cushioning device adaptable to all types of shampoo basins. As best illustrated in FIGS. 1A and 1C, the cushioning pad 12 is generally hexagonal in shape as mentioned above. The shape of cushioning pad 12 is symmetrical about two orthogonal axes 30 and 32. The first axis 30 is generally transverse to a person's head and neck, while the second axis 32 is generally in longitudinal alignment with a person's head and neck. In other words, in use, the neck cushioning device 10 will be placed on the neck-receiving notches such that one of the flaps with suction cups is attached within the sink of the shampoo basin, while the other flap is attached to the outside of the shampoo basin. As can be seen, the dimension of cushioning pad 12 along the first axis 30 is greater than the dimension of the cushioning pad 12 along the second axis 32. Consequently, this configuration takes pressure off a patron's entire neck area and also alleviates pressure from the base of the occipital bone. Thus, neck cushioning device 10 provides total support to the entire neck.

In the preferred embodiment, the gel-based material of cushioning pad 12 comprises a pliable gel having a water-soluble humectant entrapped within a polymeric matrix having therein acrylic acid or acrylamide monomer moieties. For example, although a wide variety of formulations can be utilized for the gel-based material, the polymeric matrix is most preferably formed of acrylamide, whereas the humectant is in the form of glycerin. Other components may also be utilized, such as methylenebisacrylamide cross-linking agent, ammonium persulfate initiator and citric acid. A desirable feature of such a formulation is that the gel retains its pliability and other physical properties over a very broad temperature range, such as −200 to 305° F. Thus, the gel-based neck cushioning device 10 can be heated in a microwave, for example, for extra comfort and relaxation of the patron at the shampoo basin. Due to the ability of neck cushioning device 10 to form and fit anyone's neck, water will not run down a patron's back during the shampoo or hair treatment process. Additionally, because the covering 14 of neck cushioning device 10 is a vinyl-based or similar material, the neck cushioning device 10 is completely sanitary. In other words, water will not get trapped within the device and thus bacteria will not grow and foul smells will be prevented. Furthermore, the neck cushioning device 10 is chemically resistant, and can be sanitized correctly with any cleanser, thereby providing longevity to the use of neck cushioning device 10.

As is evident from the foregoing description, the neck cushioning device of the present invention conforms to all types of shampoo basins to provide an improved form, fit and comfort for a patron's neck during shampoo and hair treatment processes. The neck cushioning device of the present invention is formed of a gelbased material which is thin and comfortable and thus alleviates unnecessary bulk. The neck cushioning device will remain securely attached to the shampoo basin during shampooing, and will thus prevent water from running down a patron's back during shampooing. Furthermore, the neck cushioning device of the present invention is completely sanitary and prevents water or other chemicals from deteriorating the cushion.

While this invention has been described with an emphasis upon a preferred embodiment, it will be understood by those of ordinary skill in the art that variations of the preferred embodiment may be used and that it is intended that the invention may be practiced otherwise than as specifically described herein. Accordingly, this invention includes all modifications encompassed within the spirit and scope of the invention as defined by the following claims.

I claim:

1. A neck cushioning device for use with a shampoo basin having a neck-receiving notch, the neck cushioning device comprising:

a cushioning pad formed of a gel-based material, the cushioning pad having a shape configured in such a way that the neck cushioning device conforms to a variety of different-shaped neck-receiving notches in shampoo basins, the shape of the cushioning pad being generally hexagonal in shape and being generally symmetrical about two orthogonal axes, a first of said axes being generally transverse to a person's head and neck, and wherein a first dimension of the cushioning pad along said first axis is greater than a second dimension of the cushioning pad along the other of said axes;

a covering for housing the cushioning pad, the covering formed of a flexible water-repellant material and including a pair of flap portions on opposed sides of said first axis of the cushioning pad; and a securing means for releasably securing the neck cushioning device to the shampoo basin.

2. The neck cushioning device as defined in claim 1 wherein the cushioning device conforms to both U-shaped shampoo basins and V-shaped shampoo basins.

3. The neck cushioning device as defined in claim 1 wherein the gel-based material comprises a pliable gel having a water-soluble humectant entrapped within a polymeric matrix having therein acrylic acid or acrylamide monomer moieties.

4. The neck cushioning device as defined in claim 3 wherein the polymeric matrix comprises acrylamide, and the humectant comprises glycerin.

5. The neck cushioning device as defined in claim 1 wherein the gel-based material comprises silicone.

6. The neck cushioning device as defined in claim 1 wherein the covering comprises a vinyl-based material.

7. The neck cushioning device as defined in claim 1 wherein the securing means comprises at least one suction cup attached to each flap portion.

8. A neck cushioning device for use with a shampoo basin having a neck-receiving notch and conforming to both U-shaped shampoo basins and V-shaped shampoo basins, the neck cushioning device comprising:

a generally hexagonal cushioning pad formed of a gel-based material, the gel-based material comprising a pliable gel having a water-soluble humectant trapped within a polymeric matrix having therein acrylic acid or acrylamide monomers, the cushioning pad having a shape configured in such a way that the neck cushioning device conforms to a variety of different-shaped neck-receiving notches in shampoo basins, the shape of the cushioning pad being generally symmetrical about two orthogonal axes, a first of said axes being generally transverse to a person's head and neck, and wherein a first dimension of the cushioning pad along said first axis is greater than a second dimension of the cushioning pad along the other of said axes;

a vinyl-based covering for housing the cushioning pad, the covering formed of a flexible water-repellant material and including a pair of flap portions on opposed sides of said first axis of the cushioning pad; and at least one suction cup affixed to each of the pair of flap portions for releasably securing the neck cushioning device to the shampoo basin.

9. A neck cushioning device for use with a shampoo basin having a neck-receiving notch, the neck cushioning device comprising:

a generally hexagonal cushioning pad formed of a gel-based material, the cushioning pad having a shape configured in such a way that the neck cushioning device conforms to a variety of different-shaped neck-receiving notches in shampoo basins, the shape of the cushioning pad being generally symmetrical about two orthogonal axes, a first of said axes being generally transverse to a person's head and neck, and wherein a first dimension of the cushioning pad along said first axis is greater than a second dimension of the cushioning pad along the other of said axes;

a covering for housing the cushioning pad, the covering formed of a flexible water-repellant material and including a pair of flap portions on opposed sides of said first axis of the cushioning pad; and a securing means for releasably securing the neck cushioning device to the shampoo basin.

10. The neck cushioning device as defined in claim 9 wherein the cushioning pad is generally hexagonal in shape.

11. The neck cushioning device as defined in claim 9 wherein the gel-based material comprises a pliable gel having a water-soluble humectant entrapped within a polymeric matrix having therein acrylic acid or acrylamide monomer moieties.

12. The neck cushioning device as defined in claim 11 wherein the polymeric matrix comprises acrylamide, and the humectant comprises glycerin.

13. The neck cushioning device as defined in claim 9 wherein the gel-based material comprises silicone.

14. The neck cushioning device as defined in claim 9 wherein the covering comprises a vinyl-based material.

15. The neck cushioning device as defined in claim 9 wherein the securing means comprises at least one suction cup attached to each flap portion.

16. The neck cushioning device as defined in claim 9 wherein the cushioning device conforms to both U-shaped shampoo basins and V-shaped shampoo basins.

* * * * *